US005934928A

United States Patent [19]

Endo et al.

[11] Patent Number: 5,934,928

[45] Date of Patent: Aug. 10, 1999

[54] PRESS-CONNECTING TERMINAL AND METHOD FOR MANUFACTURING THE SAME

[75] Inventors: Takayoshi Endo; Yuji Hatagishi; Toshiaki Okabe, all of Shizuoka, Japan

[73] Assignee: Yazaki Corporation, Tokyo, Japan

[21] Appl. No.: 09/041,659

[22] Filed: Mar. 13, 1998

[30] Foreign Application Priority Data

Mar. 19, 1997 [JP] Japan ..... 9-066693

[51] Int. Cl.[6] ..... H01R 4/24

[52] U.S. Cl. ..... 439/397

[58] Field of Search ..... 439/397, 398, 439/399, 400, 401, 406, 407

[56] References Cited

U.S. PATENT DOCUMENTS

| | | | |
|---|---|---|---|
| 4,097,106 | 6/1978 | Over et al. | 439/398 |
| 4,354,719 | 10/1982 | Weilder et al. | 439/398 |
| 5,577,930 | 11/1996 | Dahlem et al. | 439/399 |

FOREIGN PATENT DOCUMENTS

| | | | |
|---|---|---|---|
| 0152690 | 12/1984 | European Pat. Off. | 439/397 |
| 50-114592 | 9/1975 | Japan | H01R 9/08 |
| 54-158689 | 12/1979 | Japan | H01R 9/08 |
| 2-195664 | 8/1990 | Japan | H01R 4/24 |
| 8-17501 | 1/1996 | Japan | H01R 13/11 |
| 2203600 | 4/1987 | United Kingdom | 439/400 |

*Primary Examiner*—Neil Abrams
*Assistant Examiner*—J. F. Duverne
*Attorney, Agent, or Firm*—Sughrue, Mion, Zinn, Macpeak & Seas, PLLC

[57] ABSTRACT

A press-connecting terminal having press-connecting blades which are bent at a predetermined angle toward a contact portion side and formed in the respective leading end portions of press-connecting plate portions. Each of the press-connecting blades has a ruptured face on its leading edge face, the ruptured face being are formed when cut off a side wall, and a connecting face which is adjacent to the ruptured face and plated before the press-connecting plate portion is cut-bent from the side wall.

7 Claims, 9 Drawing Sheets

PRESS-CONNECTING TERMINAL AND METHOD FOR MANUFACTURING THE SAME

BACKGROUND OF THE INVENTION

1. Field of the Invention

The present invention relates to a press-connecting terminal with press-connecting blades formed so that an electric wire end is press-fitted therebetween and also to a method for manufacturing the same.

2. Description of the Related Art

FIG. 11(*a*) shows a conventional press-connecting terminal 1. A contact portion 2 which is brought into contact with a mating terminal is formed on one side of this press-connecting terminal 1, and an electric wire joint 3 is formed on the other side thereof. A pair of electric wire holding leaves 4, 4 are formed on the rear end side of the electric wire joint 3, and a press-connecting portion 5 is provided between the electric wire holding leaves 4, 4 and the contact portion 2. The press-connecting portion 5 is arranged so that two pairs of opposed press-connecting blades 8*a*, 8*b* are formed for a pair of side walls 7*a*, 7*b* which are formed by bending in the same direction from both sides of a bottom wall 6, each of the press-connecting blades 8*a*, 8*b* being cut-bent in such a way as to extend in a direction perpendicular to each of the side walls 7*a*, 7*b* above the bottom wall 6.

This press-connecting terminal 1 is prepared through the steps of punching the contact portion 2 and the electric wire joint 3 in a development state from a previously plated material and bending them into predetermined shapes. When the electric wire joint 3 is punched into the development state, the aforesaid press-connecting blades 8*a*, 8*b* in the development state are also cut off the respective side walls 7*a*, 7*b* in the development state.

The end of a covered electric wire is press-fitted into the gap between the pairs of press-connecting blades 8*a*, 8*b* to rupture the covered portion of the covered electric wire by means of the press-connecting blades 8*a*, 8*b*. When the conductor portion of the covered electric wire is brought into contact with the press-connecting blades 8*a*, 8*b*, the end of the covered electric wire and the press-connecting terminal 1 are electrically connected to each other.

As shown in FIG. 11(*b*), however, an edge face 9 of the press-connecting blade 8*b* has a ruptured face as it has been cut off the side wall 7*b* and has not been plated. For this reason, the edge face 9 of the press-connecting blade 8*b* is not smooth and has been brought into contact with the conductor with lower reliability.

Thereupon, the edge faces of the press-connecting blades 8*a*, 8*b* need plating after the press-connecting terminal 1 is formed. However, there exits a problem arising from an increase in costs in a case where a so-called post plating process is performed in that the edge faces have to be plated after the press-connecting terminal 1 is formed in comparison with a case where the plate material is plated before the press-connecting blades 8*a*, 8*b* are bent from the respective side walls 7*a*, 7*b*, that is, before they are punched into the development state because the press-connecting terminal is complicated in shape.

On the other hand, press-connecting terminals each having press-connecting blades whose edge faces are free from rupture are described in Japanese Patent Unexamined Publication Nos. Sho. 50-114592 and Sho. 54-158689. The press-connecting terminal 10 described in Japanese Patent Unexamined Publication No. Sho. 50-114592 is, as shown in FIGS. 12(*a*), 12(*b*), and 12(*c*), formed with a pair of opposed press-connecting blades 13*a*, 13*b* which are formed by punching a pair of side walls 12*a*, 12*b* of a press-connecting portion 11 inward, respectively. With the blades 13*a*, 13*b*, their contact portions with a conductor have been plated, whereby the reliability of the electrical connections with respect to the conductor can be secured satisfactorily.

The press-connecting terminal 15 described in Japanese Patent Unexamined Publication No. Sho. 54-158689 is, as shown in FIGS. 13(*a*), 13(*b*), and 13(*c*), formed with a pair of opposed press-connecting blades 18*a*, 18*b* which are formed by punching a pair of side walls 17*a*, 17*b* of a press-connecting portion 16 inward, respectively. In this press-connecting terminal 15 like the press-connecting terminal 10, the contact portions of the press-connecting blades 18*a*, 18*b* with respect to a conductor have also been plated, whereby the reliability of the electrical connections with respect to the conductor can be secured satisfactorily.

In the press-connecting terminals 10, 15 having the press-connecting blades 13*a*, 13*b*, 18*a*, 18*b* as described in Japanese Patent Unexamined Publication Nos. Sho. 50-114592 and Sho. 54-158689, since the edge faces of the respective press-connecting blades 13*a*, 13*b*, 18*a*, 18*b* are arcuate in shape, the covered portion of the covered electric wire is difficult to cut off and consequently satisfactory electric connection with the conductor portion may hardly be obtainable. In the press-connecting terminals 10, 15 described in the above patent publications, the force of holding the covered electric wire is weak as the covered-wire catching portions of the press-connecting blades 13*a*, 13*b*, 18*a*, 18*b* are small and when external force is applied in the axial direction of the electric wire while the wire harness is being pulled, inconvenience tends to occur in that an electric wire 14 easily slips off the press-connecting terminal 10.

Therefore, it is considered to narrow the width L of the leading end portion of the press-connecting blade 18*b* in such a manner as to overlap the punched portions out of the side wall 17*b* as shown in FIG. 13(*c*). In this case, however, the width L of the leading end portion of the press-connecting blade 18*b* cannot be decreased to less than twice as thick as the plate of the side wall 17*b*, and this results in failure to ensure that the covered portion of the covered electric wire is cut off.

SUMMARY OF THE INVENTION

It is therefore an object of the present invention to provide a press-connecting terminal and a method for manufacturing the same adapted to ensure that the covered portion of a covered electric wire is cut off in order to secure the sufficient force of holding the electric wire and to reduce plating cost.

In order to accomplish the above object, the invention provides a press-connecting terminal comprising: a contact portion with a mating terminal; a press-connecting portion provided on one side of the contact portion and including a bottom wall and a pair of side walls formed by bending in the same direction from both sides of the bottom wall; a pair of opposed press-connecting plate portions provided in the press-connecting portion and formed by cut-bending so that each of the press-connecting plate portions extends from each of the side walls above the bottom wall; and a pair of press-connecting blades each provided in a leading end portion of each of the press-connecting plate portions and bent at a predetermined angle toward the contact portion, wherein each of the press-connecting blades includes a ruptured face on its leading edge face formed when cut off each of the side walls, and a connecting face adjacent to the ruptured face and plated before each of the press-connecting plate portions is cut-bent from each of the side walls.

Further, the invention provides a press-connecting terminal comprising: a contact portion with a mating terminal; a press-connecting portion provided on one side of the contact portion and including a bottom wall and a pair of side walls formed by bending in the same direction from both sides of the bottom wall; and a pair of opposed press-connecting plate portions provided in the press-connecting portion and formed by cut-bending so that each of the press-connecting plate portions extends from each of the side walls above the bottom wall, wherein a thickness of each of the press-connecting plate portions is set to be less than that of each of the side walls.

Still further, the invention provides a method for manufacturing a press-connecting terminal comprising the steps of: punching from a plate material which has been plated, in a development state, a contact portion with a mating terminal and a press-connecting portion provided on one side of the contact portion and having a pair of side walls formed by bending in the same direction from both sides of a bottom wall; providing a pair of opposed press-connecting plate portions formed by cut-bending so that the press-connecting plate portions extend in a direction perpendicular to the respective side walls above the bottom wall between the side walls; forming a pair of press-connecting blades each by bending a leading end portion of each of the press-connecting plate portions at a predetermined angle toward the contact portion; and providing each of the press-connecting blades with a connecting face which is adjacent to a ruptured face cut off each of the side walls.

BRIEF DESCRIPTION OF THE DRAWINGS

FIG. 1(*b*) is a partially enlarged perspective view of a press-connecting portion.

FIG. 4(*b*) is a sectional view of the modified example.

FIG. 11(*b*) is a partially enlarged perspective view of the conventional press-connecting terminal.

FIG. 12(*b*) is a partially enlarged perspective view of the conventional press-connecting terminal.

FIG. 12(*c*) is a plan view of a state in which the end of a covered electric wire is press-fitted into a press-connecting portion.

FIG. 13(*b*) is a partially enlarged perspective view of the conventional press-connecting terminal.

FIG. 13(*c*) is a perspective view illustrative of the thickness of the press-connecting blade.

DETAILED DESCRIPTION OF THE PREFERRED EMBODIMENTS

A description will subsequently be given of a press-connecting terminal and a method for manufacturing the same embodying the present invention.

First Embodiment

Figure 1A:
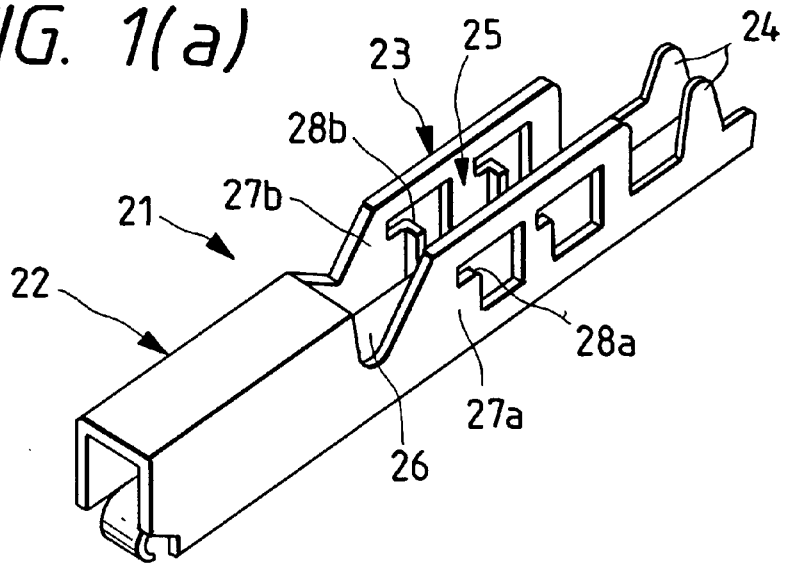
FIG. 1(*a*) is a perspective view of a press-connecting terminal as a first embodiment of the present invention.
Figure 1B:
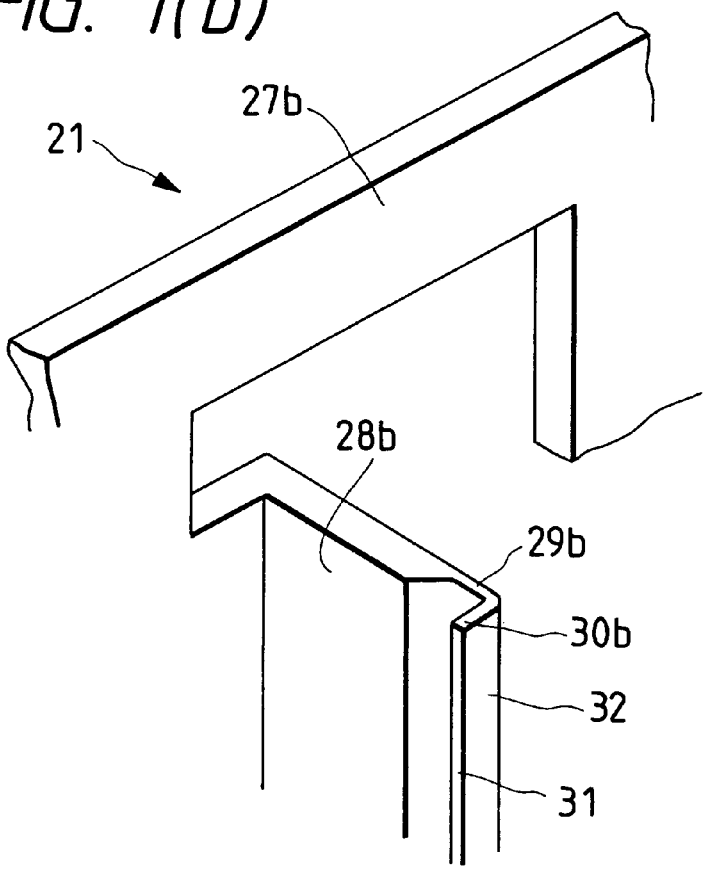

FIGS. 1(*a*) to 3 illustrate a press-connecting terminal 21 as a first embodiment of the present invention. As shown in FIG. 1(*a*), a contact portion 22 which is brought into contact with a mating terminal is formed on one side of this press-connecting terminal 21, and an electric wire joint 23 is formed on the other side thereof. A pair of electric wire holding leaves 24, 24 are formed on the rear end side of the electric wire joint 23, and a press-connecting portion 25 is provided between the electric wire holding leaves 24, 24 and the contact portion 22. The press-connecting portion 25 is arranged so that two pairs of opposed press-connecting plate portions 28*a*, 28*b* are formed for a pair of side walls 27*a*, 27*b* which are formed by bending in the same direction from both sides of a bottom wall 26, each of the press-connecting plate portions 28*a*, 28*b* being cut-bent in such a way as to extend in a direction perpendicular to each of the side walls 27*a*, 27*b* above the bottom wall 26.

According to the first embodiment of the present invention, thin-walled portions 29*a*, 29*b* whose thickness is less than that of the side walls 27*a*, 27*b* are formed in the respective end portions of the press-connecting plate portions 28*a*, 28*b*. The leading end portions of the thin-walled portions 29*a*, 29*b* are bent in a direction substantially perpendicular toward the contact portion 22, so that press-connecting blades 30*a*, 30*b* are formed. As edge faces 31, 31 of the press-connecting blades 30*a*, 30*b* are ruptured when the press-connecting blades 30*a*, 30*b* are cut-bent from the side walls 27*a*, 27*b*, the edge faces 31, 31 are formed as ruptured ones. Moreover, the portions situated outside the respective edge faces 31, 31 and adjacent thereto are formed as connecting faces 32, 32. This connecting faces 32, 32 are plated because they are not ruptured (edge faces) when the press-connecting plate portions 28*a*, 28*b* are cut-bent from the side walls 27*a*, 27*b*.

Figure 2:
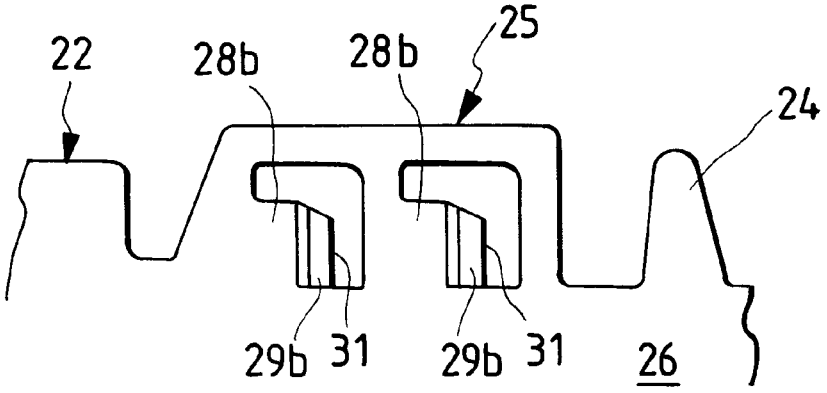
FIG. 2 is a partial plan view of the press-connecting terminal in a development state according to the first embodiment of the present invention.

When this press-connecting terminal 21 is manufactured, portions corresponding to the contact portion 22, the press-connecting portion 25 and the electric wire joint 23 are punched in a development state from a previously plated plate material as shown in FIG. 2. At this time, the side walls 27*a*, 27*b* are cut off at a position where the leading portions of the press-connecting plate portions 30*a*, 30*b* are formed as shown in FIG. 2, and the thin-walled portions 29*a*, 29*b* are formed by compressing the leading end portions of the press-connecting plate portions 28*a*, 28*b*. Then, the portions corresponding to the contact portion 22, the press-connecting portion 25 and the electric wire joint 23 are bent to form the contact portion 22 and the press-connecting portion 25.

Simultaneously, the press-connecting plate portions 28*a*, 28*b* cut off the pair of side walls 27*a*, 27*b* are bent in such a manner as to extend perpendicularly between the pair of side walls 27*a*, 27*b*, and the press-connecting blades 30*a*, 30*b* are formed by substantially perpendicularly bending the thin-walled portions 29*a*, 29*b* provided in the leading portions of the press-connecting plate portions 28*a*, 28*b* toward the contact portion 22. The edge faces 31, 31 of the press-connecting blades 30*a*, 30*b* become ruptured when the press-connecting plate portions 28*a*, 28*b* are ruptured from the side walls 27*a*, 27*b*, whereas the portions situated outside the ruptured faces and adjacent thereto are formed as the connecting faces 32, 32. Therefore, the connecting faces 32, 32 are plated so that their surfaces are smoothed, though the edge faces (ruptured faces) 31 are not plated.

In order to connect the-end of a covered electric wire 33 to the press-connecting portion 25 of the press-connecting terminal 21, the end portion of the covered electric wire 33 is positioned at an upper portion between the pair of side walls 27*a*, 27*b* of the press-connecting portion 25 and then press-fitted in between the pair of press-connecting blades 30*a*, 30*b* by means of a press-connecting jig (not shown). When the covered portion of the covered electric wire 33 is press-fitted in between the pair of press-connecting blades 30*a*, 30*b*, the press-connecting blades 30*a*, 30*b* break the covered portion of the covered electric wire 33, and the exposed conductor portion is brought into contact with the connecting faces 32, 32, whereby the end portion of the covered electric wire 33 is electrically connected to the press-connecting terminal 21.

Figure 3:
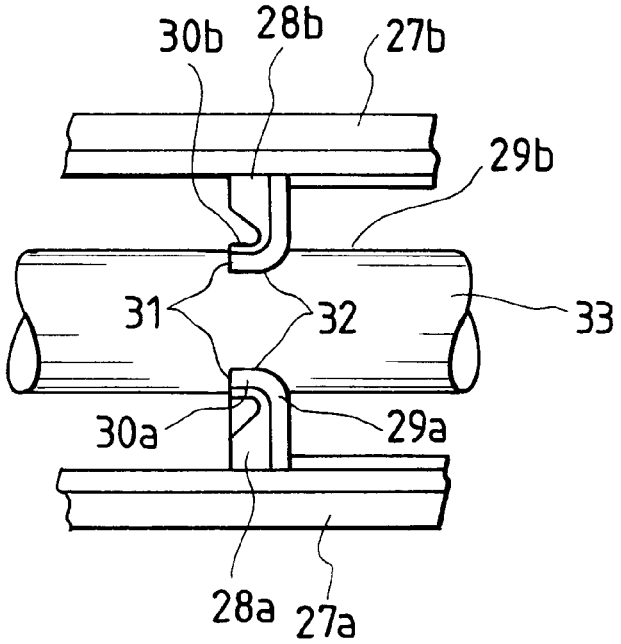
FIG. 3 is a plan view of a state in which the end of a covered electric wire is press-fitted into the press-connecting portion of the press-connecting terminal according to the first embodiment of the present invention.

FIG. 3 shows a state in which the end portion of the covered electric wire 33 has been press-fitted into the press-connecting portion 25 of the press-connecting terminal 21. In this state, the edge faces 31, 31 of the press-connecting blades 30*a*, 30*b* as ruptured faces without being plated are directed toward the contact portion 22, whereas the connecting faces 32, 32 are directed to the outer peripheral face of the covered electric wire 33. Therefore, a corner portion where the edge face 31 is continuous to the connecting face 32 forms an edge for cutting off the covered portion, so that the connecting faces 32, 32 are brought into contact with the conductor.

In the press-connecting-terminal 21 according to this embodiment of the present invention, the press-connecting blades 30*a*, 30*b* are provided in the thin-walled portions 29*a*, 29*b* whose thickness is less than that of the side walls 27*a*, 27*b*, whereby the press-connecting blades 30*a*, 30*b* become sharp to ensure that the covered portion of the covered electric wire is cut off.

Since it is ensured that the covered portion is cut off by the press-connecting blades 30*a*, 30*b*, moreover, it is also ensured that the press-connecting blades 30*a*, 30*b* bite into the covered electric wire 33. Consequently, the force of holding the covered electric wire 33 against the axial force thereof is secured satisfactorily.

In the press-connecting terminal 21 according to this embodiment of the present invention, the edge faces 31, 31 without being plated do not come into contact with the conductor for conduction, but the plated connecting faces 32, 32 adjacent to the respective edge faces 31, 31 come into contact with the conductor, whereby reliability of electrical connection is made improvable.

Since the plated connecting faces 32, 32 are caused to contact the conductor by bending the press-connecting blades 30*a*, 30*b* toward the contact portion 22 in the press-connecting terminal according to this embodiment of the present invention, it is not necessary to plate the contacting faces with the conductor after the press-connecting terminal 21 is shaped but only to plate the plate material previously before the press-connecting terminal 21 is punched from the plate material and formed by bending. Consequently, no plating is required after the press-connecting terminal 21 is shaped, whereby the plating cost becomes reducible.

According to this embodiment of the present invention, further, even though force is applied to the covered electric wire 33 in a direction in which it slips off the press-connecting portion 25, it hardly slips off since the press-connecting blades 30*a*, 30*b* are bent in a direction substantially perpendicular toward the contact portion 22. Therefore, the force of holding the electric wire is secured satisfactorily.

Figure 4A:
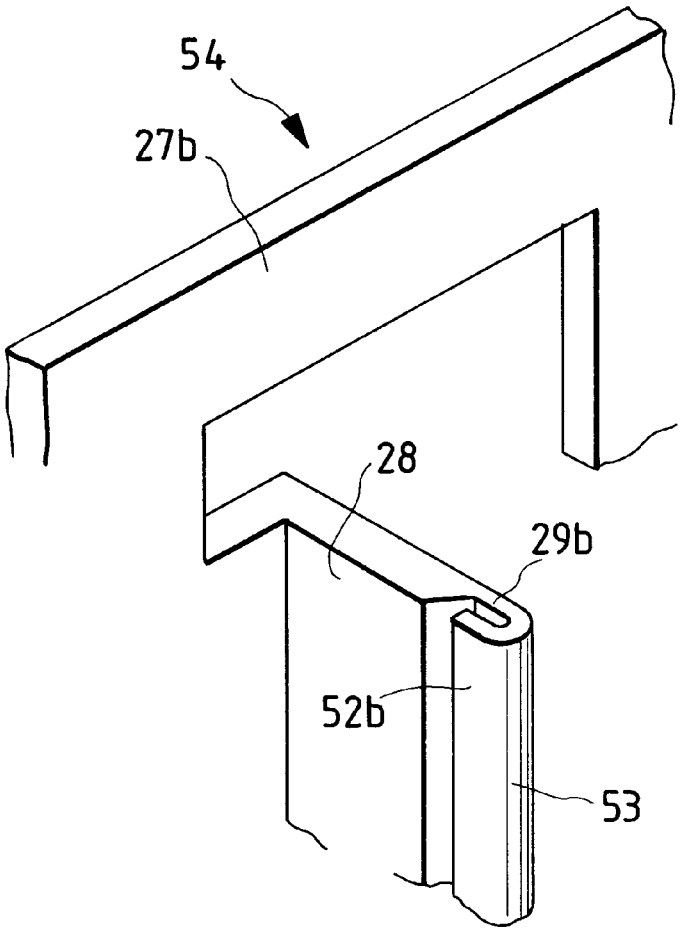
FIG. 4(*a*) is a perspective view of a modified example of the first embodiment of the present invention.
Figure 4B:
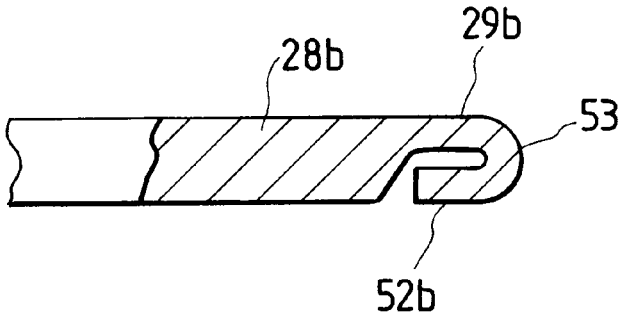

A description will subsequently be given of a press-connecting terminal 54 as a modified example of the first embodiment of the present invention with reference to FIGS. 4(*a*) and 4(*b*). In the case of the press-connecting terminal 54, an angle at which the thin-walled portions 29*a*, 29*b* (however, only thin-walled portion 29*b* is shown in FIGS. 4(*a*) and 4(*b*)) are bent is different from what is defined in the preceding embodiment of the present invention. More specifically, the thin-walled portions 29*a*, 29*b* are bent and folded up further perpendicularly to form press-connecting blades 52*a*, 52*b* (however, only press-connecting blade 52*b* is shown in FIGS. 4(*a*) and 4(*b*)) in this example as shown in FIGS. 4(*a*) and 4(*b*), though they are bent in the direction substantially perpendicular toward the contact portion 22 in the preceding embodiment of the present invention.

The arcuate leading edge faces of the press-connecting blades 52*a*, 52*b* are formed as connecting faces 53 which are brought into contact with the conductor of the covered electric wire. The connecting faces 53 are plated and become smoothed.

In the press-connecting terminal 54 according to this example, the thin-walled portions 29*a*, 29*b* are folded up to form the press-connecting blades 52*a*, 52*b*, so that the strength of the press-connecting blades 52*a*, 52*b* is increased. In a state in which the covered electric wire has been press-connected, the force of holding the electric wire is secured satisfactorily. Since the connecting faces 53 are plated, high reliability of the connection with respect to the conductor of the covered electric wire is secured.

Second Embodiment

A description will subsequently be given of a press-connecting terminal 35 as a second embodiment of the present invention with reference to FIGS. 5 and 6. Incidentally, like reference characters are given to like component parts and the description thereof will be omitted.

Figure 5:
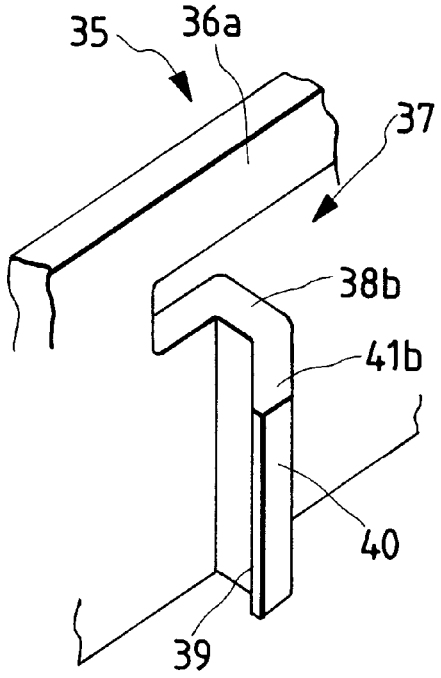
FIG. 5 is a partially enlarged perspective view of a press-connecting portion of a press-connecting terminal as a second embodiment of the present invention.
Figure 6:
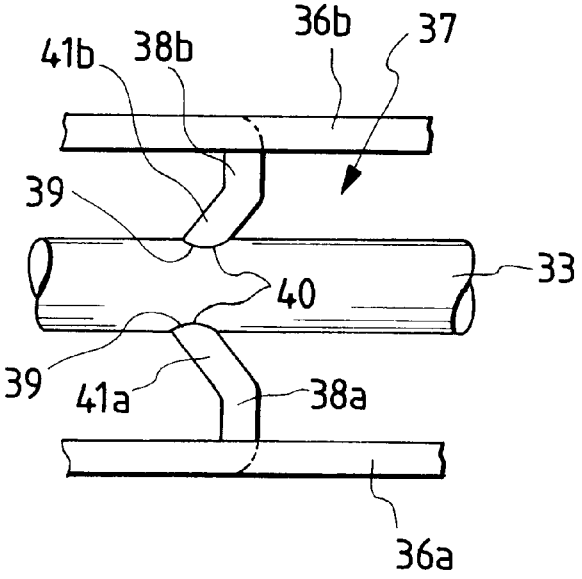
FIG. 6 is a plan view of a state in which the end of a covered electric wire is press-fitted into the press-connecting portion of the press-connecting terminal according to the second embodiment of the present invention.

As shown in FIGS. 5 and 6, a pair of opposed press-connecting plate portions 38*a*, 38*b* formed by cut-bending so as to extend in a direction perpendicular to a pair of side walls 36*a,* 36*b* are provided in a press-connecting portion 37 of the press-connecting terminal 35. The leading end sides of the press-connecting plate portions 38*a,* 38*b* are bent at a predetermined angle and press-connecting blades 41*a,* 41*b* are formed in the leading end portions thereof. The edge faces 39 of the press-connecting blades 41*a,* 41*b* are formed as cut faces when the press-connecting plate portions 38*a,* 38*b* are cut off the side walls 36*a,* 36*b.*

Connecting faces 40 are formed outside the respective edge faces 39 and made adjacent thereto. Each of the connecting faces 40 is chamfered in such a manner that its thickness is gradually reduced toward the edge faces 39. The connecting faces (chamfered portions) 40 are formed by compression when the press-connecting plate portions 38*a,* 38*b* are cut off the side walls 36*a,* 36*b.* Moreover, the connecting faces 40 are plated.

Figure 7:
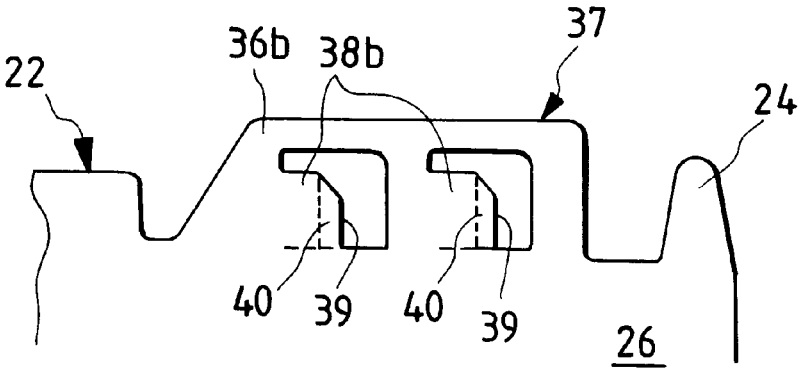
FIG. 7 is a partial plan view of the press-connecting terminal in a development state according to the second embodiment of the present invention.

When the press-connecting terminal 35 is manufactured, as shown in FIG. 7, portions corresponding to the contact portion 22 and the press-connecting portion 25 are punched in a development state from a previously plated plate material before being bent. In this case, the edge faces 39 of the press-connecting blades 41*a,* 41*b* are formed as ruptured faces without being plated when the press-connecting plate portions 38*a,* 38*b* are cut off the side walls 36*a,* 36*b.* When the connecting faces 40 are punched from the plate material, further, they are simultaneously compressed to form plated chamfered portions.

FIG. 6 shows a state in which the end portion of the covered electric wire 33 has been press-fitted into the press-connecting portion 37 of the press-connecting terminal 35. In this state, the edge faces 39 of the press-connecting blades 41*a,* 41*b* as ruptured faces without being plated are directed toward the contact portion 22, whereas the connecting faces 40 are directed to the outer peripheral face of the covered electric wire 33. Therefore, a corner portion where the edge face 39 is continuous to the connecting face 40 forms an edge for cutting off the covered portion, so that the connecting faces 40 are brought into contact with the conductor.

In the press-connecting terminal 35 according to this embodiment of the present invention, the press-connecting blades 41*a,* 41*b* are provided with connecting faces 40 as chamfered portions, whereby the press-connecting blades 41*a,* 41*b* become sharp to ensure that the covered portion of the covered electric wire is cut off.

Since it is ensured that the covered portion is cut off by the press-connecting blades 41*a,* 41*b,* moreover, it is also ensured that the press-connecting blades 41*a,* 41*b* bite into the covered electric wire 33. Consequently, the force of holding the covered electric wire 33 against the axial force thereof is secured satisfactorily.

Also in the press-connecting terminal 35 according to this embodiment of the present invention, since the plated connecting faces 40 adjacent to the respective edge faces 39 come into contact with the conductor, whereby reliability of electrical connection is made improvable.

Since the plated connecting faces 40 are caused to contact the conductor by bending the press-connecting blades 41*a,* 41*b* toward the contact portion 22 in the press-connecting terminal 35 according to this embodiment of the present invention like the press-connecting terminal 21, it is not necessary to plate the contacting faces with the conductor after the press-connecting terminal 35 is shaped but only to plate the plate material previously before the press-connecting terminal 35 is punched from the plate material and formed by bending. Consequently, no plating is required after the press-connecting terminal 35 is shaped, whereby the plating cost becomes reducible.

According to this embodiment of the present invention, further, even though force is applied to the covered electric wire 33 in a direction in which it slips of the press-connecting portion 37, it hardly slips off since the press-connecting blades 41*a,* 41*b* are bent in a direction substantially perpendicular toward the contact portion 22. Therefore, the force of holding the electric wire is secured satisfactorily.

Third Embodiment

A description will subsequently be given of a press-connecting terminal 42 as a third embodiment of the present invention with reference to FIGS. 8 to 10. The press-connecting terminal 42 is provided with press-connecting plate portions 43 formed by respectively bending a pair of side walls inward and folding back the bent portions toward the pair of side walls instead of the fact that the press-connecting blades 30*a,* 30*b,* 41*a,* 41*b* of the press-connecting terminals 21, 35 in the first and second embodiments of the present invention have the ruptured faces cut from the side walls 27*a,* 27*b,* 36*a,* 36*b.*

Figure 8:
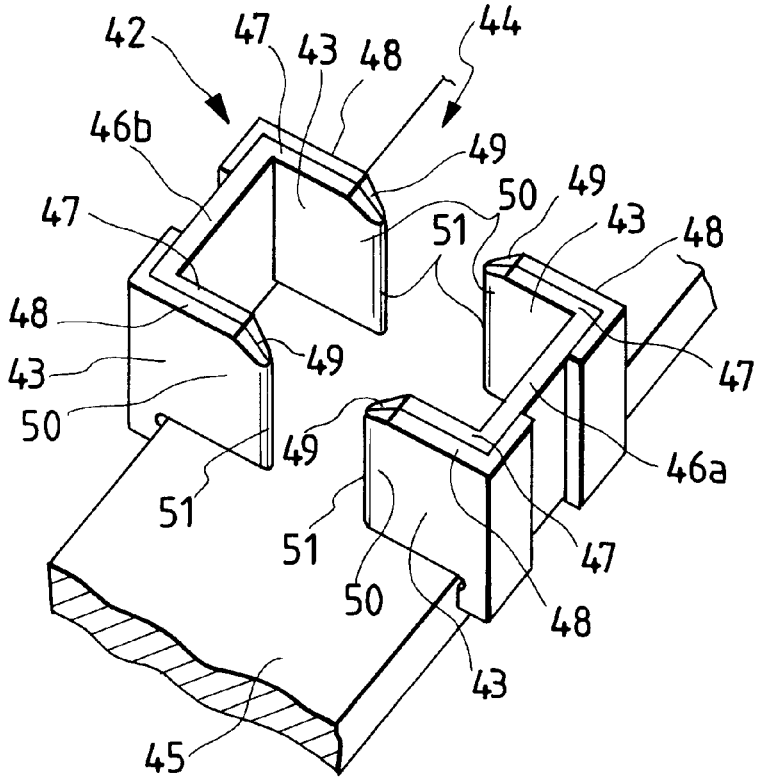
FIG. 8 is a perspective view of a press-connecting portion of a press-connecting terminal as a third embodiment of the present invention.

In a press-connecting portion 40 of the press-connecting terminal 42, as shown in FIG. 8, there are formed press-connecting half plate portions 47 respectively bent from a pair of side walls 46*a,* 46*b* bent-formed in the same direction on both sides of a bottom wall 45 through the pair of side walls 46*a,* 46*b* in such a manner as to extent from the bottom wall 45. The leading end portions of the press-connecting half plate portions 47 are bent toward the side walls 46*a,* 46*b* to form press-connecting half plate portions 48, and these press-connecting half plate portions 47, 48 are stacked up to form press-connecting plate portions 43. Tilted faces 49 are formed in the upper corner portions of the respective folded back portions of the press-connecting half plate portions 47, 48. Further, the tilted faces 49 and the folded back portions of the press-connecting half plate portions 47, 48 are used as press-connecting blades 50, respectively.

Figure 9:
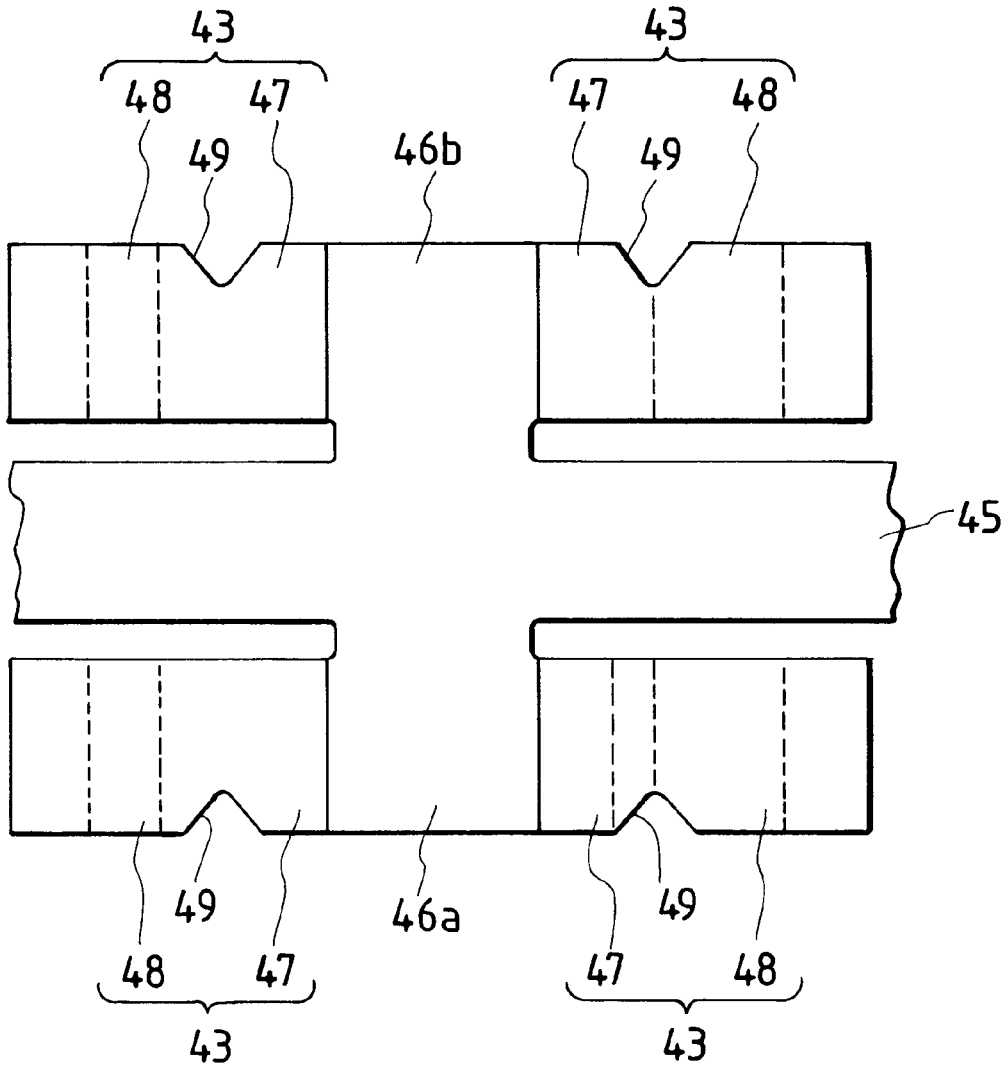
FIG. 9 is a plan view of the press-connecting portion of the press-connecting terminal in a development state according to the third embodiment of the present invention.
Figure 10:
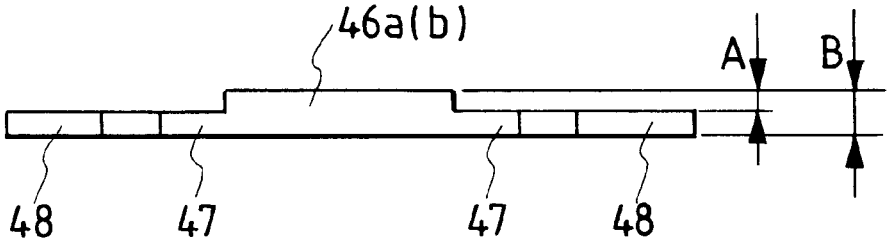
FIG. 10 is a plan view of a side wall of the press-connecting portion of the press-connecting terminal according to the third embodiment of the present invention.
Figure 11A:
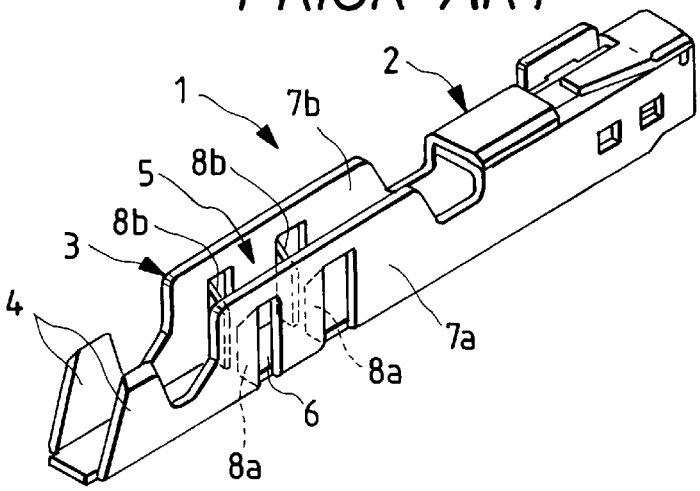
FIG. 11(a) PRIOR ART
FIG. 11(*a*) is a perspective view of a conventional press-connecting terminal.
Figure 11B:
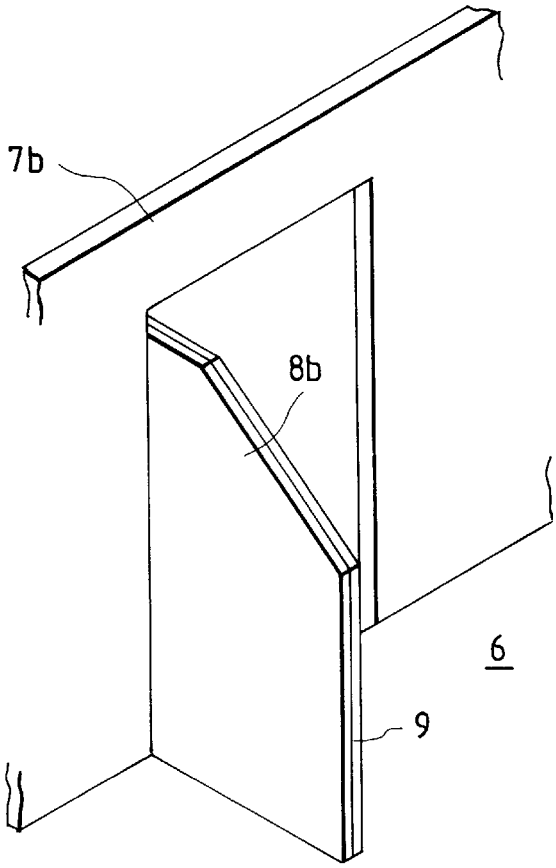
FIG. 11(b) PRIOR ART
Figure 12A:
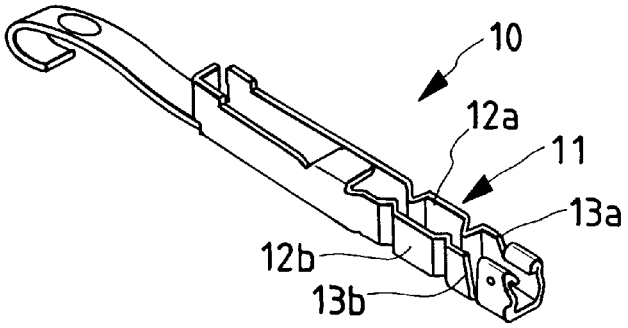
FIG. 12(a) PRIOR ART
FIG. 12(*a*) is a perspective view of a conventional press-connecting terminal whose press-connecting blades are different in shape from those of the press-connecting terminal shown in FIGS. 11(*a*) and 11(*b*).
Figure 12B:
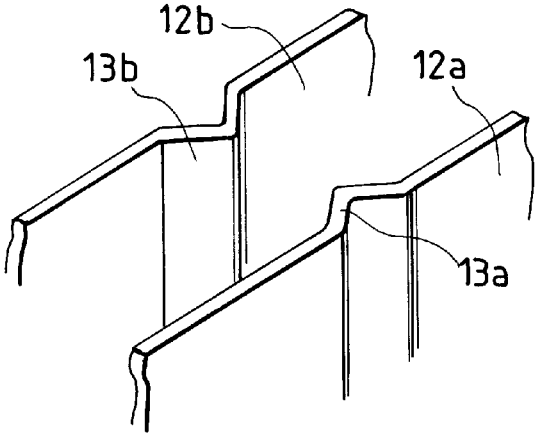
FIG. 12(b) PRIOR ART
Figure 12C:
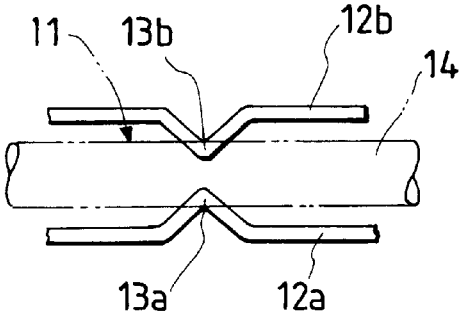
FIG. 12(c) PRIOR ART
Figure 13A:
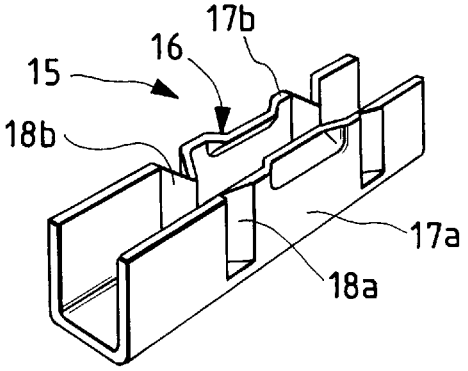
FIG. 13(a) PRIOR ART
FIG. 13(*a*) is a perspective view of another conventional press-connecting terminal whose press-connecting blades are different in shape from those of the press-connecting terminal shown in FIGS. 11(*a*) and 11(*b*).
Figure 13B:
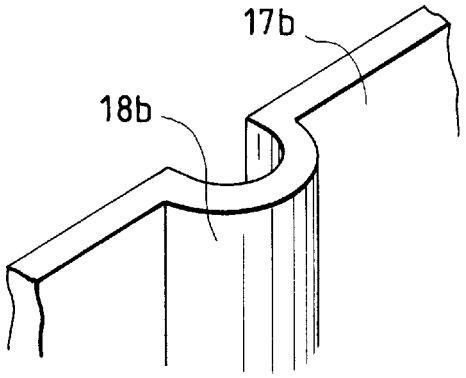
FIG. 13(b) PRIOR ART
Figure 13C:
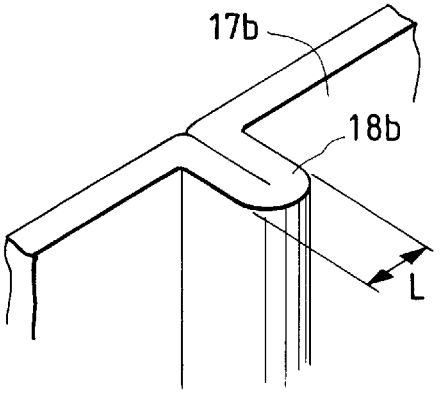
FIG. 13(c) PRIOR ART

As shown in FIG. 9, the press-connecting half plate portions 47, 48 are respectively formed on both sides of the side walls 46*a,* 46*b* in a development state and as shown in FIG. 10, the plate thickness A is set to be less than the thickness B of the side walls 46*a,* 46*b.* Further, the dimension derived from the folded press-connecting half plate portions 47, 48 is set to be equal to or less than the thickness of the side walls 46*a,* 46*b.*

In this press-connecting terminal 42, portions corresponding to the contact portion 22 and the press-connecting portion 44 are punched from a previously plated plate material in a development state and simultaneously portions corresponding to the press-connecting half plate portions 47, 48 are compressed to set the thickness thereof to be less than that of the side walls 46*a,* 46*b.* In this state, the contact portion 22 and press-connecting portion 44 are bent-formed, and the press-connecting half plate portions 47 are substantially perpendicularly bent between the side walls 46*a,* 46*b.* Further, the press-connecting half plate portions 48 are folded back toward the side walls 46*a,* 46*b* and the portions 47 and 48 are stacked up to form the press-connecting plate portions 43. In this case, the corner portions of the tilted faces 49 of the upper folded up portions of the press-connecting half plate portions 47, 48 are formed as edge portions, whereby the covered portion of the covered electric wire is ruptured. Moreover, the folded up portions of the press-connecting half plate portions 47, 48 are used as connecting faces 51 with the conductor. In this case, the connecting faces 51 are plated.

As the thickness of the press-connecting plate portions 43 formed by stacking the press-connecting half plate portions

47, 48 in the press-connecting terminal 42 according to this embodiment of the present invention is set to be less than that of the side walls 46*a,* 46*b,* the covered portion of the covered electric wire 33 is easily cut to ensure that the covered portion is cut off.

The connecting faces 51 with the conductor in the press-connecting terminal 42 according to this embodiment of the present invention are plated, whereby reliability of electrical connection is made improvable.

Since the contacting faces with the conductor also in the press-connecting terminal 42 according to this embodiment of the present invention are plated, it is not necessary to plate the contacting faces after the press-connecting terminal 42 is shaped, whereby the plating cost becomes reducible.

As set forth above, in the press-connecting terminal according to the present invention, the press-connecting blades formed by bending the leading end portions of the press-connecting plate portions cut-bent from the respective side walls at the predetermined angle toward the contact portion respectively have the plated connecting faces which are adjacent to the ruptured faces cut off from the pair of side walls in the press-connecting terminal. Consequently, each plated connecting face is brought into contact with the conductor of the covered electric wire when the end of the covered electric wire is press-fitted in between the press-connecting blades, whereby the reliability of the electrical connection is secured satisfactorily. Moreover, plating cost becomes reducible because it is not necessary to plate the press-connecting blades after the press-connecting terminal is formed.

The covered electric wire is ruptured by the pair of press-connecting blades to ensure that the electric wire is caught by the press-connecting blades, whereby the force of holding the electric wire is secured satisfactorily.

In the method for manufacturing the press-connecting terminal according to the present invention, the portion adjacent to the ruptured face formed on the edge face of the press-connecting blade is brought into contact with the conductor portion of the covered electric wire by bending the press-connecting blade of the press-connecting terminal toward the contact portion side. Consequently, high reliability of the electrical connection is secured.

What is claimed is:

1. A press-connecting terminal comprising:

a contact portion with a mating terminal;

a press-connecting portion provided on one side of said contact portion and including a bottom wall and a pair of side walls formed by bending in the same direction from both sides of the bottom wall;

a pair of opposed press-connecting plate portions provided in said press-connecting portion and formed by cut-bending so that each of said press-connecting plate portions extends from each of the side walls above the bottom wall; and a pair of press-connecting blades each provided in a leading end portion of each of said press-connecting plate portions and bent at a predetermined angle toward said contact portion, wherein each of said press-connecting blades includes a ruptured face on its leading edge face formed when cut off each of the side walls, and a connecting face adjacent to the ruptured face and plated before each of said press-connecting plate portions is cut-bent from each of the side walls.

2. The press-connecting terminal as claimed in claim 1, wherein each of said press-connecting blades includes a thin-walled portion whose thickness is less than that of each of said press-connecting plate portions.

3. The press-connecting terminal as claimed in claim 2, wherein each of said press-connecting blades is formed by folding up the thin-walled portion.

4. The press-connecting terminal as claimed in claim 1, wherein the connecting face is a chamfered portion formed by punching in the leading end portion of each of said press-connecting plate portions before the connecting face is plated and before each of said press-connecting plate portions is cut-bent from each of the side walls.

5. A press-connecting terminal comprising:

a contact portion with a mating terminal;

a press-connecting portion provided on one side of said contact portion and including a bottom wall and a pair of side walls formed by bending in the same direction from both sides of the bottom wall; and a pair of opposed press-connecting plate portions provided in said press-connecting portion and formed by cut-bending so that each of said press-connecting plate portions extends from each of the side walls above the bottom wall, wherein a thickness of each of said press-connecting plate portions is set to be less than that of each of the side walls.

6. A method for manufacturing a press-connecting terminal comprising the steps of:

punching from a plate material which has been plated, in a development state, a contact portion with a mating terminal and a press-connecting portion provided on one side of the contact portion and having a pair of side walls formed by bending in the same direction from both sides of a bottom wall;

providing a pair of opposed press-connecting plate portions formed by cut-bending so that the press-connecting plate portions extend in a direction perpendicular to the respective side walls above the bottom wall between the side walls;

forming a pair of press-connecting blades each by bending a leading end portion of each of the press-connecting plate portions at a predetermined angle toward the contact portion; and providing each of the press-connecting blades with a connecting face which is adjacent to a ruptured face cut off each of the side walls.

7. The method as claimed in claim 6, further comprising the step of setting a thickness of a material portion used for forming the press-connecting blades to be less than that of each of the side walls when the contact portion and the press-connecting portion are punched from the plate material in the development state.

* * * * *